US006152378A

United States Patent [19]

Alekseevich et al.

[11] Patent Number: 6,152,378

[45] Date of Patent: Nov. 28, 2000

[54] MIST CLEARING METHOD AND EQUIPMENT

[75] Inventors: Palei Aleksei Alekseevich; Lapshin Vladimir Borisovich; Popova Irina Sergeevna; Chernishev Leonid Sergeevich, all of Moscow, Russian Federation; Masaya Tanaka; Katsuji Yamamoto, both of Tokyo, Japan

[73] Assignee: Ishikawajima-Harima Heavy Industries Co., Ltd., Tokyo, Japan

[21] Appl. No.: 09/284,744

[22] PCT Filed: Oct. 27, 1997

[86] PCT No.: PCT/JP97/03882

§ 371 Date: Apr. 19, 1999

§ 102(e) Date: Apr. 19, 1999

[87] PCT Pub. No.: WO98/19017

PCT Pub. Date: May 7, 1998

[30] Foreign Application Priority Data

Oct. 30, 1996 [JP] Japan ..... 8-288847

[51] Int. Cl.[7] ..... E01H 13/00; A01G 15/00

[52] U.S. Cl. ..... 239/2.1; 239/14.1

[58] Field of Search ..... 239/2.1, 2.2, 14.1

[56] References Cited

U.S. PATENT DOCUMENTS

| | | | |
|---|---|---|---|
| 3,534,907 | 10/1970 | Bellis | 239/14.1 X |

FOREIGN PATENT DOCUMENTS

| | | | |
|---|---|---|---|
| 64-32747 | 3/1989 | Japan | B03C 3/00 |
| 7-80347 | 3/1995 | Japan . | |
| 7-197428 | 8/1995 | Japan | E01H 13/00 |
| 8-218340 | 8/1996 | Japan | E01H 13/00 |
| 9211673 | 7/1992 | WIPO | 239/2.1 |

*Primary Examiner*—Andres Kashnikow
*Assistant Examiner*—Robin O. Evans
*Attorney, Agent, or Firm*—Pearne & Gordan LLP

[57] ABSTRACT

An applying means in a discharge means includes a set of electrodes, and the electrodes face the ground level, are aligned along one continuous plane, are separated from each other at specified intervals in the horizontal direction, and are set to the same electrical potential. When the direct current high voltage is supplied from a power supply means, electric force lines are directed upward in the air above the applying means, producing charged particles based on corona discharge from the applying means. The charged particles absorb water in the air, condensing and binding into water, and dispersing the fog.

6 Claims, 13 Drawing Sheets

PERCENTAGE OF ACCUMULATED FOG PRESENCE AS A FUNCTION OF TIME WHEN INSTALLATION IS NOT IN OPERATION.

PERCENTAGE OF ACCUMULATED FOG PRESENCE AS A FUNCTION OF TIME WHEN INSTALLATION IS IN OPERATION.

MIST CLEARING METHOD AND EQUIPMENT

TECHNICAL FIELD

The present invention relates to a method for dispersal of fog and an installation thereof, and in particular, to a technique for the dispersal of fog over land traffic roads such as automobile roads and railroads, airports, harbors, and golf courses.

BACKGROUND ART

When visibility is low because of fog over automobile roads and airports, these facilities are closed to ensure safety, and this leads to large financial losses.

Methods for dispersing fog are disclosed in a first technical example: "Electrostatic Net for Liquefaction and Elimination of Fog" in Japanese Utility Model Application No. Sho 64-32747, a second technical example: "Method for Improving Hydro-Atmospheric Phenomenon and an Apparatus therefor" in Japanese Patent Application, First Publication No. Hei 7-197428, and a third technical example: "Method for Improving Hydro-Atmospheric Phenomenon and Apparatus therefor" in Japanese Patent Application, First Publication No. Hei 8-218340.

In the first technical example, conductive nets are arranged on both sides of a conductive fine wire, and a high voltage is applied to the conductive fine wire to produce a corona discharge, so that charged fog particles are absorbed by the conductive nets with ground electrodes using Coulomb force and are collected as water drops.

In the second technical example, a direct current high voltage is applied to a corona discharge wire to produce a corona discharge. Another direct current high voltage with the polarity opposite or identical to the corona discharge wire is applied to the charged particles driven by an electric field of the corona discharge wire, so that the charged particles are affected by the electrical field of the control wire. Thus, the charged particles are conducted to adhere to water in the air, condensing and binding into water, and dispersing the fog.

In the third technical example, a direct current high voltage is applied to a corona discharge wire to produce corona discharge. Another direct current high voltage with the polarity opposite to that applied to the corona discharge wire is applied to control wires, which are aligned in the horizontal direction, are separated from each other at a specified interval, and are positioned above the corona discharge wire. Charged particles produced by the corona discharge are driven upward by the electric field of the control wires, adhering to water in the air, condensing and binding into water, and dispersing the fog.

However, there is some problems as to the effect of the dispersal of fog over wide areas. Further, there is a problem that, because the conductive nets, the corona discharge wire, the control wire, and the high voltage direct current power sources must be prepared to disperse fog over wide areas, it is difficult to achieve reduction of the costs.

The present invention is intended to resolve the above-described technical problems, and has the following as its goals:

(1) The expansion of the fog dispersal area.

(2) The achievement of controlling and managing the fog dispersal area.

(3) The simplification of the device and the reduction of the costs.

(4) The expanding of the applicability to land traffic roads such as automobile roads and railroads, airports, harbors, and golf courses.

DISCLOSURE OF INVENTION

An applying means in a discharge means includes a set of electrodes, and the electrodes face the ground level, are aligned along one continuous plane, are separated from each other at specified intervals in the horizontal direction, and are set to the same electrical potential.

The applying means is positioned at a fixed level. When the direct current high voltage is supplied from a power supply means, electric force lines are directed upward in the air above the applying means, producing charged particles based on corona discharge from the applying means. The charged particles adheres to water in the air, condensing and binding into water, and dispersing the fog.

The applying means comprises a plurality of the electrodes, which are a plurality of fine wires aligned in parallel in the horizontal direction. The voltage applied to a plurality of the wires is set to the same value, and a difference in electrical potential between the wires is prevented.

The negative direct current high voltage of more than −55 kV is applied to the applying means.

A set of the wires are each supported by poles, are aligned in parallel, and are elevated at the same height.

BEST MODE OF CARRYING OUT THE INVENTION

In the following, the embodiment of the method for the dispersal of fog and the installation thereof of the present invention will be explained referring to FIGS. 1 through 3.

Figure 1:
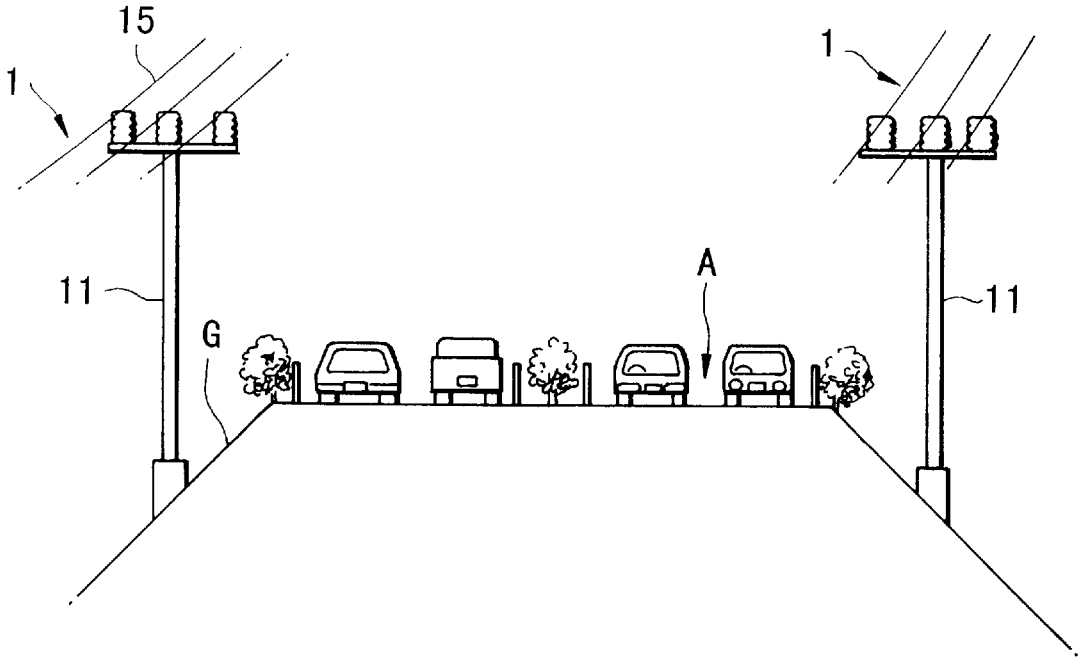
FIG. 1 is a front cross sectional view showing one embodiment of the method for dispersal of fog and the installation thereof according to the present invention.
Figure 2:
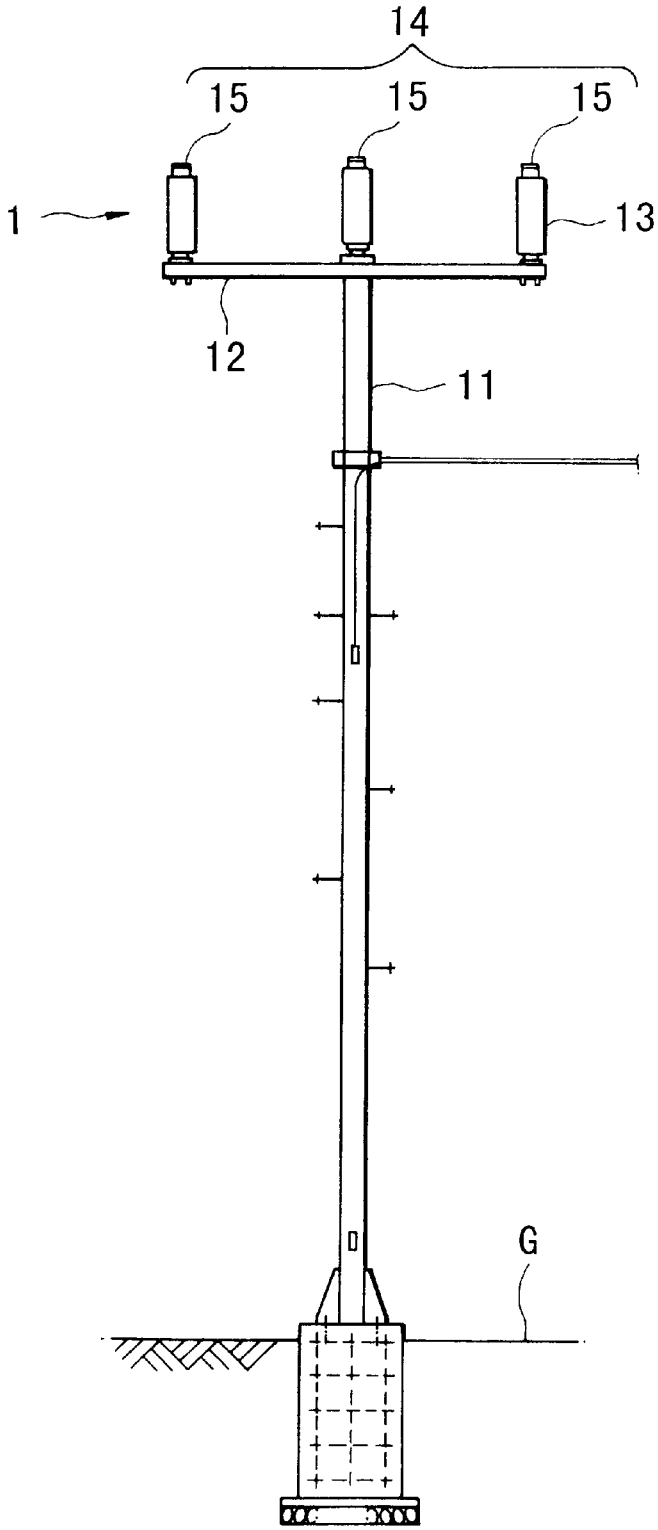
FIG. 2 is a front view of a discharge means of FIG. 1.
Figure 3:
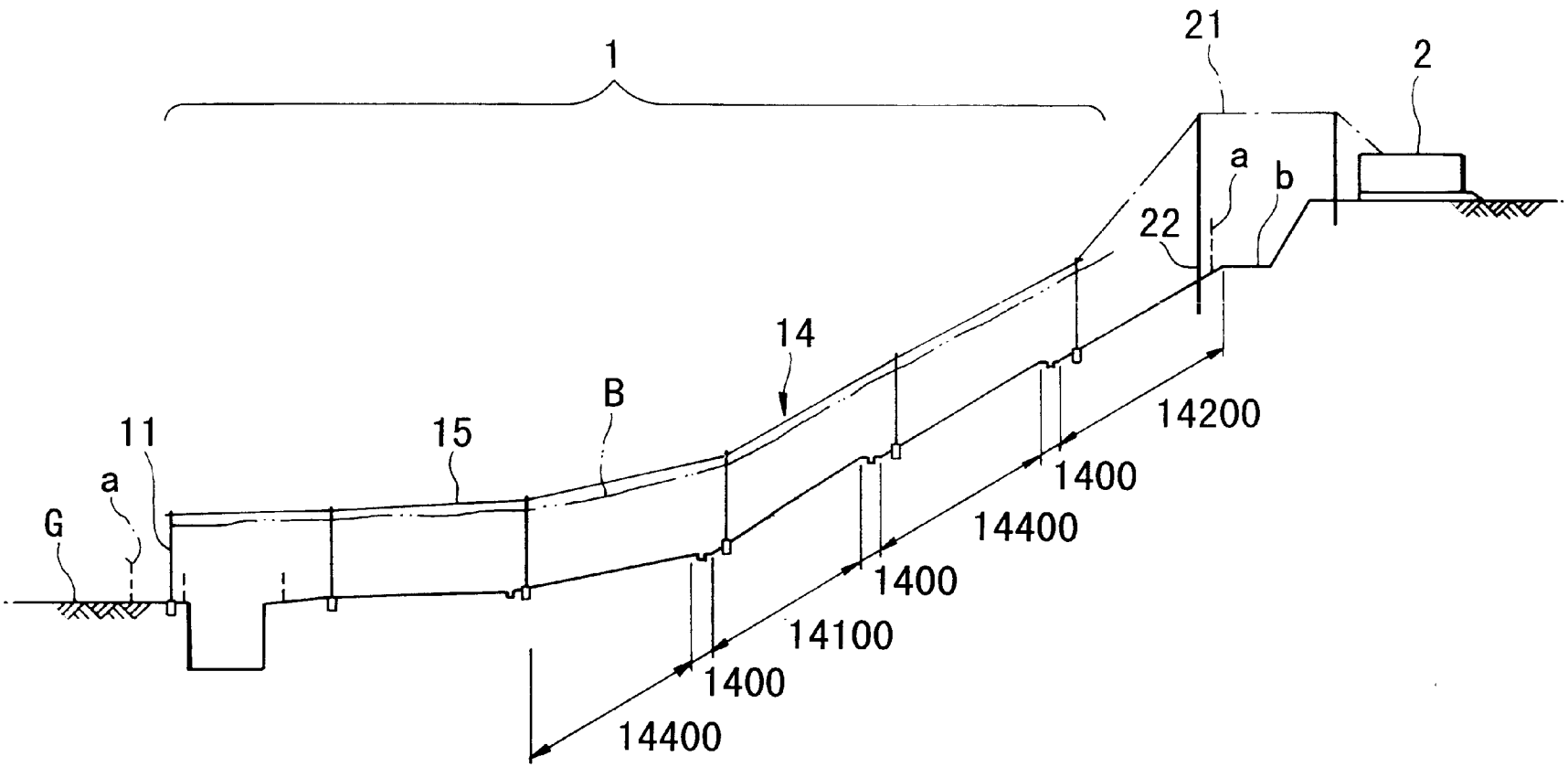
FIG. 3 is a side cross-sectional view showing the embodiment of the method for dispersal of fog and the installation thereof according to the present invention.

In FIGS. 1 to 3, reference character A denotes a land traffic road, reference character G denotes the ground level, reference numeral 1 denotes a discharge means, reference numeral 2 denotes a power supply means, and reference character B denotes a continuous plane.

The land traffic road A, as shown in FIG. 1, is an automobile road (for example, a highway). An area which includes this road and its periphery is a fog dispersal object region, in which the installation for the dispersal of fog are appropriately provided.

The ground G, in other words, the installation area of the installation for the dispersal of fog, is preferably horizontal and flat, or a gentle continuous slope as a whole which includes slope planes continued from flat planes. Preferably, the ground G has no irregularities as shown in FIG. 3.

The discharge means 1, as shown FIGS. 1 and 3, comprises a plurality of poles 11, support arms 12 held horizontally at the upper portions of the poles 11, a plurality of, for example, three insulators 13 attached to the support arms 12 in an upward direction and separated from each other at specified intervals in the horizontal direction, an applying means 14 provided between the tops of the insulators 13 of the poles 11, and a set of a plurality of electrodes (wires) 15 constituting the applying means 14.

Preferably, the poles 11 extend from the ground level (the earth's surface) to the insulators 13 and the electrodes 15, and preferably provide an upper space above the land traffic road A as shown in FIG. 1. Even when the electrodes 15 are not positioned above or near the land traffic road A, the electrodes 15 are positioned at the height of several meters or several tens of meters.

The electrodes 15 are discharge wires with the minimum permissible diameters. Each electrode 15 is supported at the same level with respect to each pole 11 as the other electrodes 15 by a plurality of (for example, three) insulators 13. As shown in FIG. 3, the electrodes 11 are elevated in parallel and connected to the next pole 11 sequentially. To set all the electrodes 15 to the identical electrical potential level, the parallel portions are connected vertically or horizontally, and the poles 11 with the elevated wires covering the installation area are electrically connected, forming an even applying means 14 covering a large area along the continuous plane B.

To promote the corona discharge, the horizontal intervals between the wires are set to more than 1 m.

The power supply means 2 has functions similar to the power source device (direct current high voltage generator) disclosed in the above mentioned technical example 2: Japanese Patent Application, First Publication No. Hei 7-197428. In this embodiment, a negative high voltage (for example, a high voltage more than −55 kV) may be generated.

As shown in FIG. 3, power supply lines 21 for supplying the high voltage direct current to the applying means 14, and power supply poles 22 for supporting the power supply lines 21 are provided between the discharge means 1 and the power supply means 2.

In FIG. 3, the elevated portions of the electrodes 15 cover the large area along the continuous plane B. Safeguard fences "a" enclose the installation area of the poles 11 and the electrodes 15. An access road "b" is provided near the elevated portions of the electrodes 15.

In the following, the dispersal operation for fog using the device for the dispersal of fog shown in FIGS. 1 to 3 will be explained.

The power supply means 2 is operated and supplies the direct current high voltage with the negative electrical potential to the discharge means 1. When the direct current high voltage with the negative electrical potential is applied to the electrodes 15, charged particles (ions, electrons, or the like) are generated by corona discharge because the diameters of the electrodes 15 are small and the potential gradient around the electrodes is more than several kV/cm.

Figure 4:
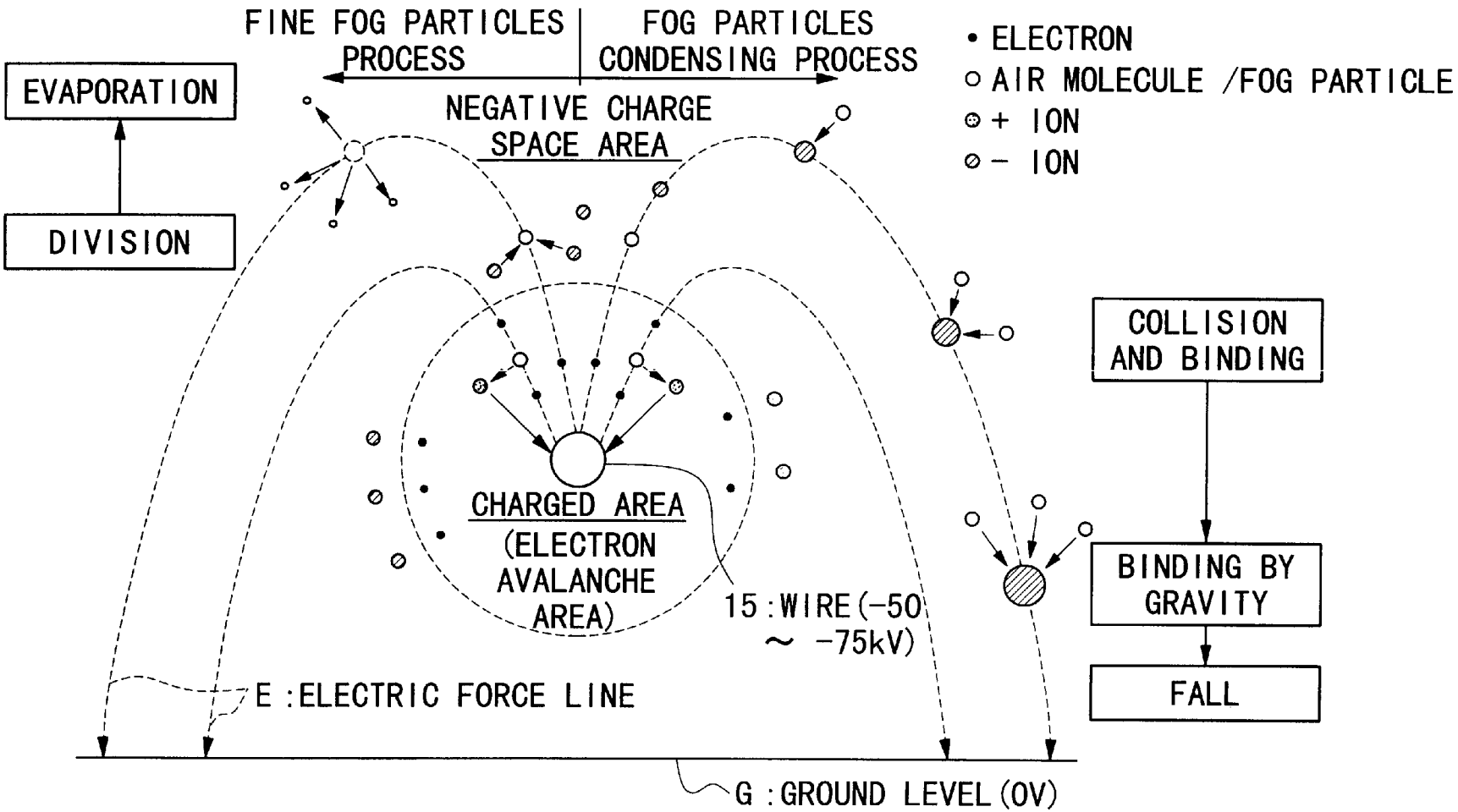
FIG. 4 is a schematic view showing the fog dispersal operation by the method for dispersal of fog and the installation thereof according to the present invention.

FIG. 4 is a schematic diagram showing the fog dispersal operation.

When the direct current high voltage with the negative electrical potential is applied, the corona discharge is generated based on the potential gradient around the electrodes 15, and the charged particles such as negative ions are generated near the electrodes 15 by the corona discharge.

The negative ions are driven in an electrostatic manner depending on electric force lines E around the electrodes 15.

As shown in FIG. 4 of a schematic diagram showing a process of condensing fog particles, because the traveling negative ions collide with the water particles in the air (water vapor gas) or they are attracted each other by the Coulombic force, the particles gradually enlarge, and finally fall as water drops.

That is, assuming that there is one electric force line E around the electrode 15, when the water molecules or a mist (fog particles) exist around the electric force line, particle formation, in which the charged particles moving through the mist, etc., adhere together, is produced. As the weights of the particles increase, the falling speeds increase, and the water drops quickly fall to the ground level G and are removed from the air, thus dispersing the fog.

In the process for the fine fog particles schematically shown in FIG. 4, when the traveling negative ions become larger while traveling along the electric force line E, the repulsive forces of the negative ions and the adhering force provided by the surface tension of the water drops may be unbalanced. Because of the repulsive forces of the negative ions, the water drops are divided, and parts of the ions are evaporated, thus dispersing the fog.

Table 1 shows the corona sparking voltage when the three wires 15 are supported at the same level by the discharge means 1 of FIG. 2, when the negative direct current high voltage is applied.

TABLE 1

| No. | $H_1$(m) | $H_2$(m) | W(m) | $V_1$ (KV) | $V_2$ (KV) | $V_{1k}$ (KV) | $V_{2k}$ (KV) | Ie ($\mu$A/m) | $\rho$ ($\mu$C/m$^3$) |
|---|---|---|---|---|---|---|---|---|---|
| 8 | — | 5 | 0.6 | 0 (float) | −70 | — | −47.04 | 0.08024 | 1.73916 |
| 9 | 5.7 | 5.7 | 0.9 | −60 | −60 | −58.62 | −54.28 | 0.03178 | 0.22096 |
| 10 | 5.7 | 5.7 | 0.9 | −65 | −65 | −60.76 | −55.54 | 0.05903 | 0.33704 |

TABLE 1-continued

| No. | $H_1$(m) | $H_2$(m) | W(m) | $V_1$ (KV) | $V_2$ (KV) | $V_{1k}$ (KV) | $V_{2k}$ (KV) | Ie ($\mu$A/m) | ρ ($\mu$C/m$^3$) |
|---|---|---|---|---|---|---|---|---|---|
| 11 | 5.7 | 5.7 | 0.9 | −70 | −70 | −62.90 | −56.81 | 0.08627 | 0.43654 |
| 12 | 5.7 | 5.7 | 0.9 | −75 | −75 | −65.04 | −58.08 | 0.11352 | 0.52278 |

$H_1$: the height of the center electrode (corona wire)
$H_2$: the height of the side electrode (control wire)
W: the interval between the center and side electrodes
$V_1$: the voltage applied to the center electrode (corona wire voltage)
$V_2$: the voltage applied to the side electrode (control wire voltage)
$V_{1k}$: the corona sparking voltage of the center electrode (corona wire corona sparking voltage)
$V_{2k}$: the corona sparking voltage of the side electrode (control wire corona sparking voltage)
Ie: the earth current ($\mu$A/m)
ρ: the maximum space charge density ($\mu$C/m$^3$: $10^{-6}$ Coulomb/m$^3$)

Figure 5:
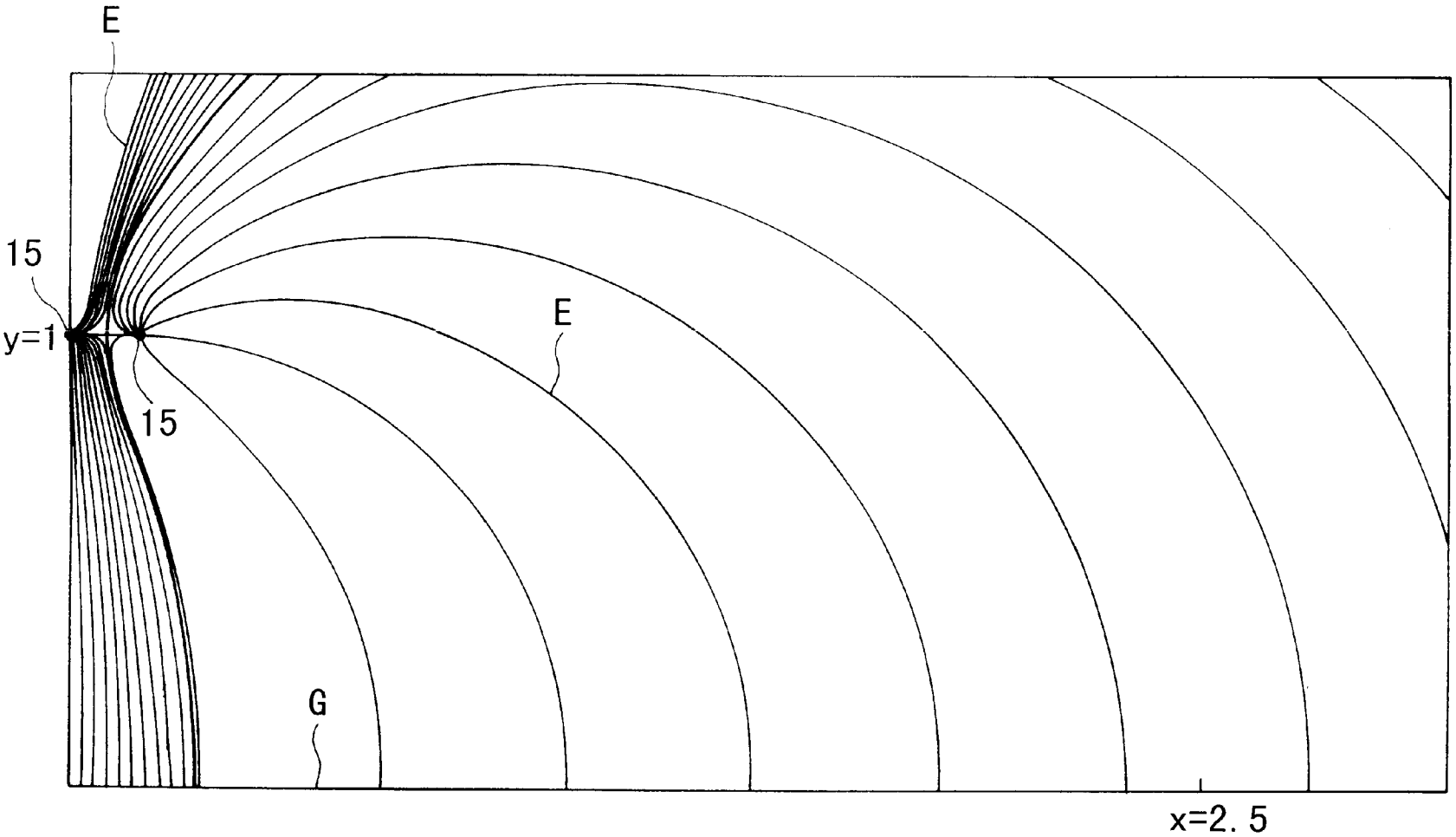
FIG. 5 is a front view showing electric force lines produced by the discharge means of FIG. 2.

FIG. 5 shows the result of the electric force lines E calculated by computer analysis when the three wires 15 positioned at the height of 5.7 m from the ground level G are aligned in the horizontal direction at intervals of 0.9 m, and when the direct current high voltage of the same negative electrical potential is applied to the wires.

In the figure, "y=1" represents the distance of 5.7 m from the ground G, and "x=2.5" represents two and a half times of the distance of 5.7 m.

It should be noted in FIG. 5 that the electric force lines E are dense between the center wire 15 and the side wire 15, and below and above the wires 15.

When the corona discharge (discharge by more than the corona sparking voltage) is generated in the portion where the electric force lines E are dense and the potential gradient around the wires 15 is high, charged particles such as the negative ions are produced, and, as explained in FIG. 4, are driven in an electrostatic manner depending on the electric force lines E around the electrodes 15. Then, particle formation, in which the charged particles moving through the mist, etc., adhere together and increase their weights, is produced, removing the mist from the air, and dispersing the fog.

The fog dispersal operation is performed in the area under the wires 15 in FIG. 5 and in the air above the wires 15, in particular, in the areas in which the densities of the electric force lines E are high.

That is, by directing the electric force lines E upward in the air above the wires 15 when the voltage is applied, condensation and binding into water in the air are produced positively, and thus the fog is dispersed over the wide area.

In the following, an example in which the method for the dispersal of the fog and the installation are applied to a land traffic road will be explained.

Figure 6:
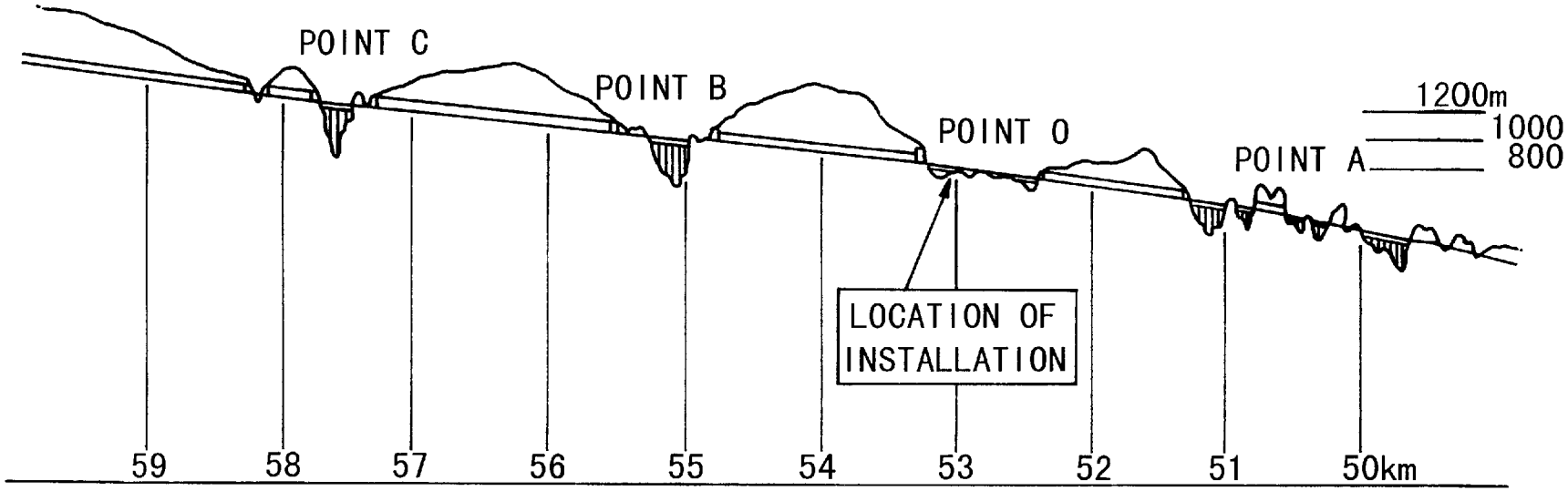
FIG. 6 is a vertical cross-sectional view showing the embodiment of the method for dispersal of fog and the installation thereof according to the present invention applied to a land traffic road.
Figure 7:
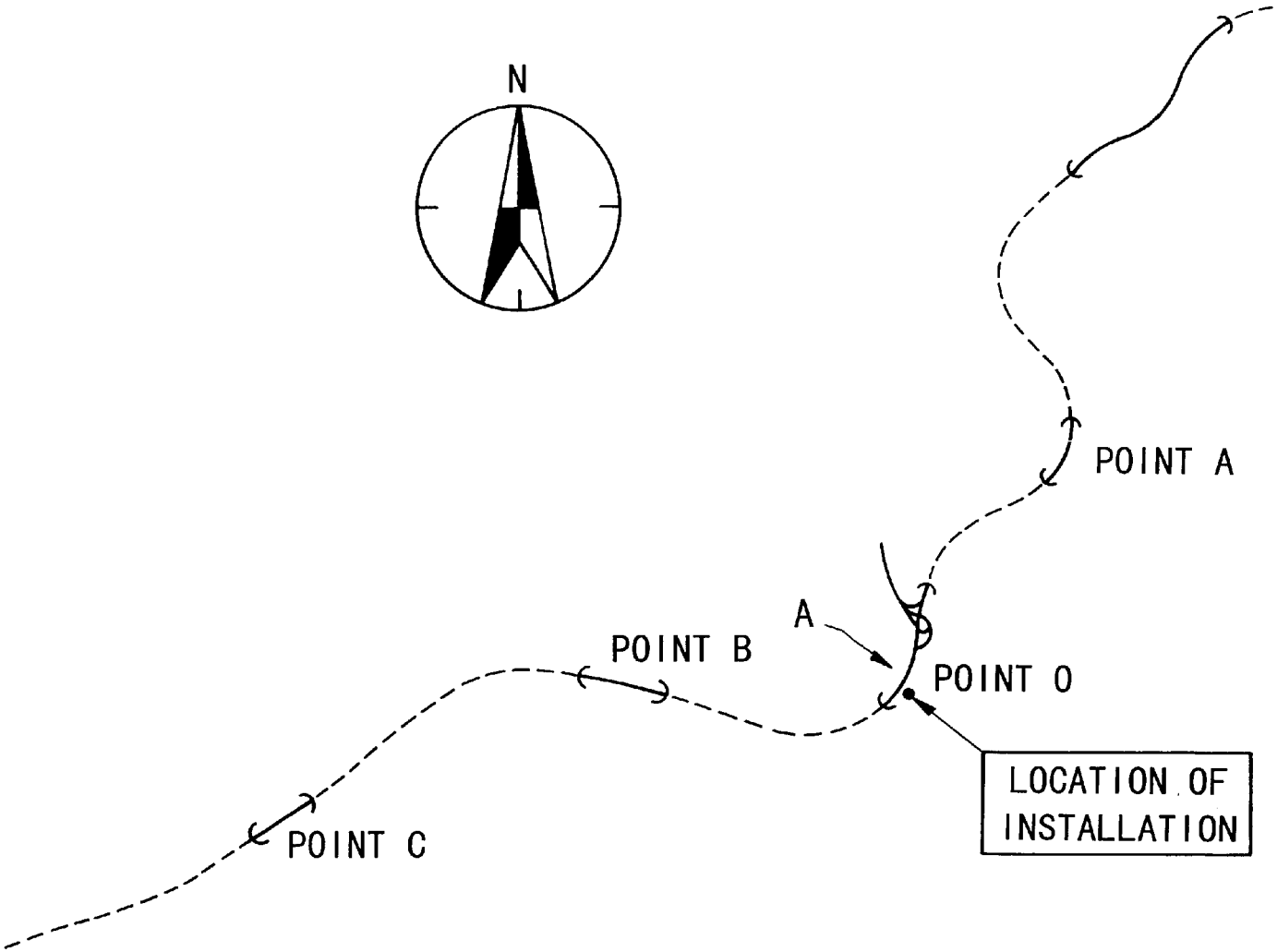
FIG. 7 is a top view showing the area shown in FIG. 6.

The installation for the dispersal of fog of FIGS. 2 and 3 is installed at a point O as shown in FIGS. 6 and 7, is actually operated, and then the result confirms the fog dispersal effect.

The height of the poles 15 from the ground level G is 6.6 m, the intervals between the three wires 15 are 1 m, the interval between the poles 11 are approximately 15 m, and the entire range of the elevated portion of the wires 15 is approximately 100 meters square.

As shown in FIG. 6, observation points are set at points A and B distant from the point O.

Table 2 shows operating conditions of the fog dispersal installation shown in FIGS. 2 and 3 at the point O.

TABLE 2

| No. | IN OPERATION/ NOT IN OPERATION | OPERATING TIME START | OPERATING TIME END | CORONA VOLTAGE (KV) | TEST CONDITION | TEST RESULT |
|---|---|---|---|---|---|---|
| 21 | NOT IN OPERATION | 8/2 | 8/3 | — | | — |
| 22 | NOT IN OPERATION | 8/3 | 8/4 | — | | — |
| 23 | IN OPERATION | 8/5 | 8/6 | −75 | The current is stable. | ○ |
| 24 | IN OPERATION | 8/6 | 8/7 | −75 | The current is stable. | ○ |
| 25 | IN OPERATION | 8/27 | 8/29 | −75 | The current increases when it rains. | ○ |
| 26 | NOT IN OPERATION | 8/29 | 8/30 | — | | — |
| 27 | NOT IN OPERATION | 8/30 | 9/1 | — | | — |
| 28 | IN OPERATION | 9/6 | 9/7 | −75 | The current increases when it rains. | ? |

TABLE 2-continued

| No. | IN OPERATION/ NOT IN OPERATION | OPERATING TIME START | OPERATING TIME END | CORONA VOLTAGE (KV) | TEST CONDITION | TEST RESULT |
|---|---|---|---|---|---|---|
| 29 | IN OPERATION | 9/6 | 9/10 | −75 | The current increases when it rains. | ○ |
| 30 | IN OPERATION | 9/14 | 9/14 | −75 | The current increases when it rains. | ○ |
| 31 | NOT IN OPERATION | 9/16 | 9/16 | — | | — |
| 32 | NOT IN OPERATION | 9/16 | 9/17 | — | | — |
| 33 | IN OPERATION | 9/20 | 9/20 | −75 | The current is stable, but tends to increase when it rains. | ○ |

In Table 2, "No." represents the data sampling number, 8/2 or the like in "START" and "END" of "OPERATING TIME" represents the date, and "○" in "TEST RESULT" means effective.

"The current is stable" means that the power supply current of the installation is stable, and "the current increases" means that the power supply current increases when the installation is operated.

Figure 8:
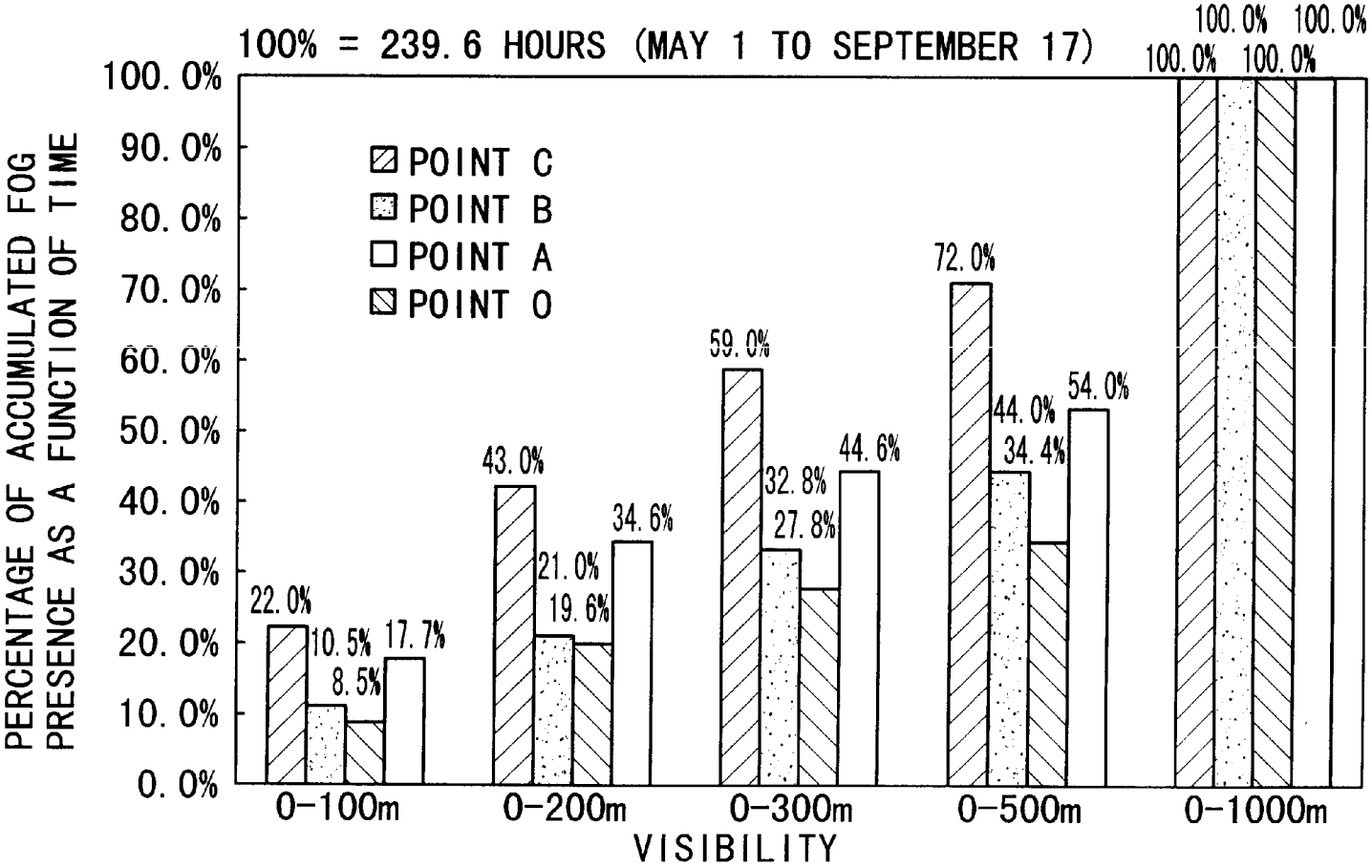
FIG. 8 is a bar graph showing percentage of accumulated fog presence as a function of time in the area shown in FIG. 6 when the installation is not in operation.
Figure 9:
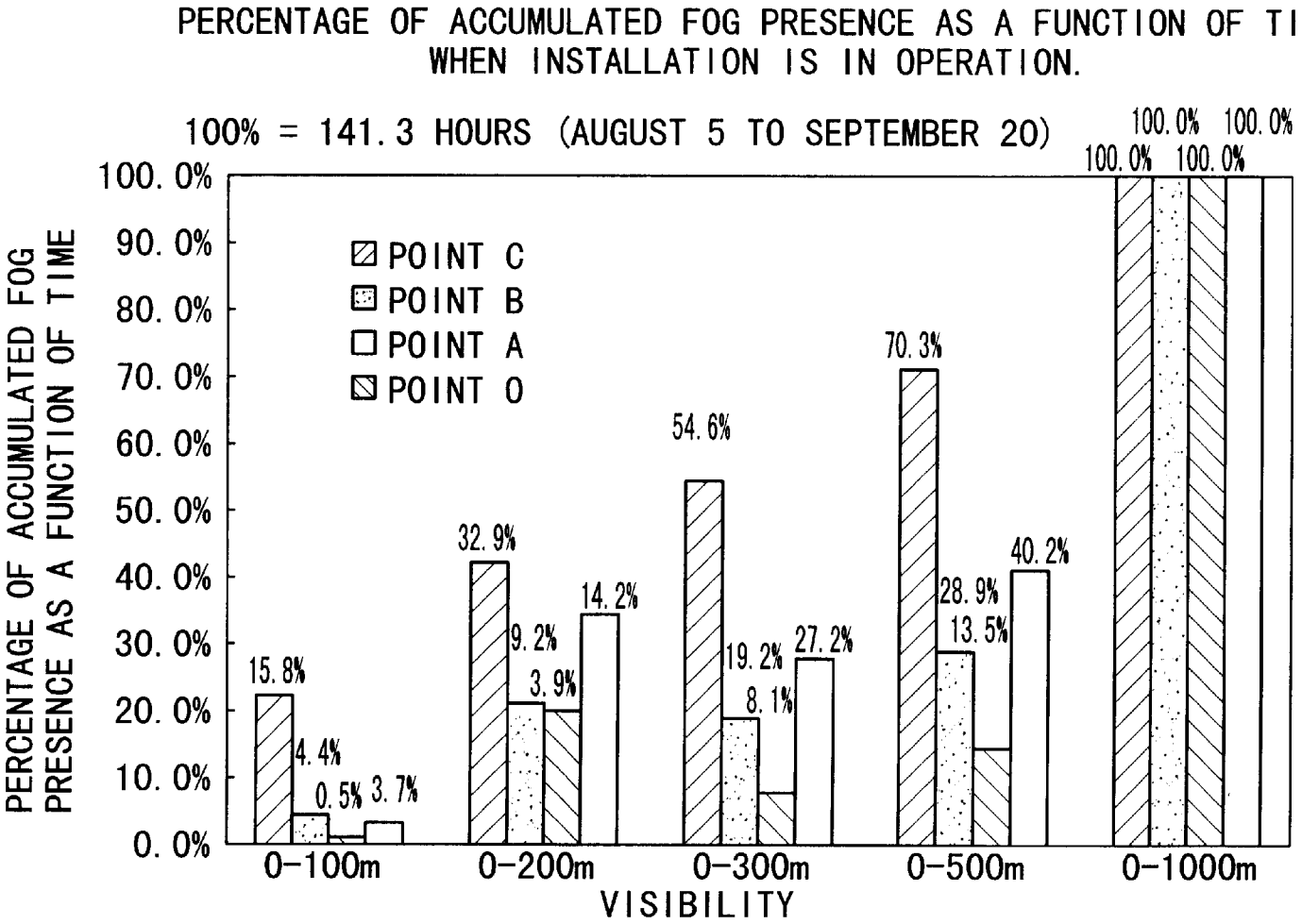
FIG. 9 is a bar graph showing percentage of accumulated fog presence as a function of time in the area shown in FIG. 6 when the installation is in operation.

FIGS. 8 and 9 show percentage of accumulated fog presence as a function of time when the fog dispersal installation is operated and not operated.

FIG. 8 shows the percentage of visibility of below 100 m, below 200 m, below 300 m, below 500 m, and below 1000 m, when the fog occurs, the dispersal installation is not in operation, and the measurement has been carried out for a total time of 239.6 hours.

FIG. 9 shows the percentage of visibility of below 100 m, below 200 m, below 300 m, below 500 m, and below 1000 m, when the fog occurs and when the dispersal installation has been operated for a total time of 141.3 hours.

As these results are compared, even when the installation is not in operation, the percentage of the decreased visibility at the point O near the location of the installation are lower than those at the distant points A, B, and C. When the installation is in operation, the visibility of below 100 m at the point O is 0.5%, and this means that the fog dispersal by the installation is effected.

At the point A and B distant from the point O by 2 km (see FIG. 6), the visibility of below 100 m and below 200 m is improved.

Even in the points distant from the point O, the improved effect at the point A is higher. Because the point A is geographically lower than the point O (see FIG. 6), it seems that the condensation of the charged particles explained with reference to FIG. 5 is promoted.

FIGS. 10 to 13 show the fog dispersal effects at the points A, B, and C based on the data of FIGS. 8 and 9.

The figures show how the percentage of visibility of above 0 and below 100 m, above 100 m and below 200 m, above 200 m and below 300 m, above 300 m and below 500 m, and above 500 m and below 1000 m change depending on the operation or the non-operation of the installation.

Figure 10:
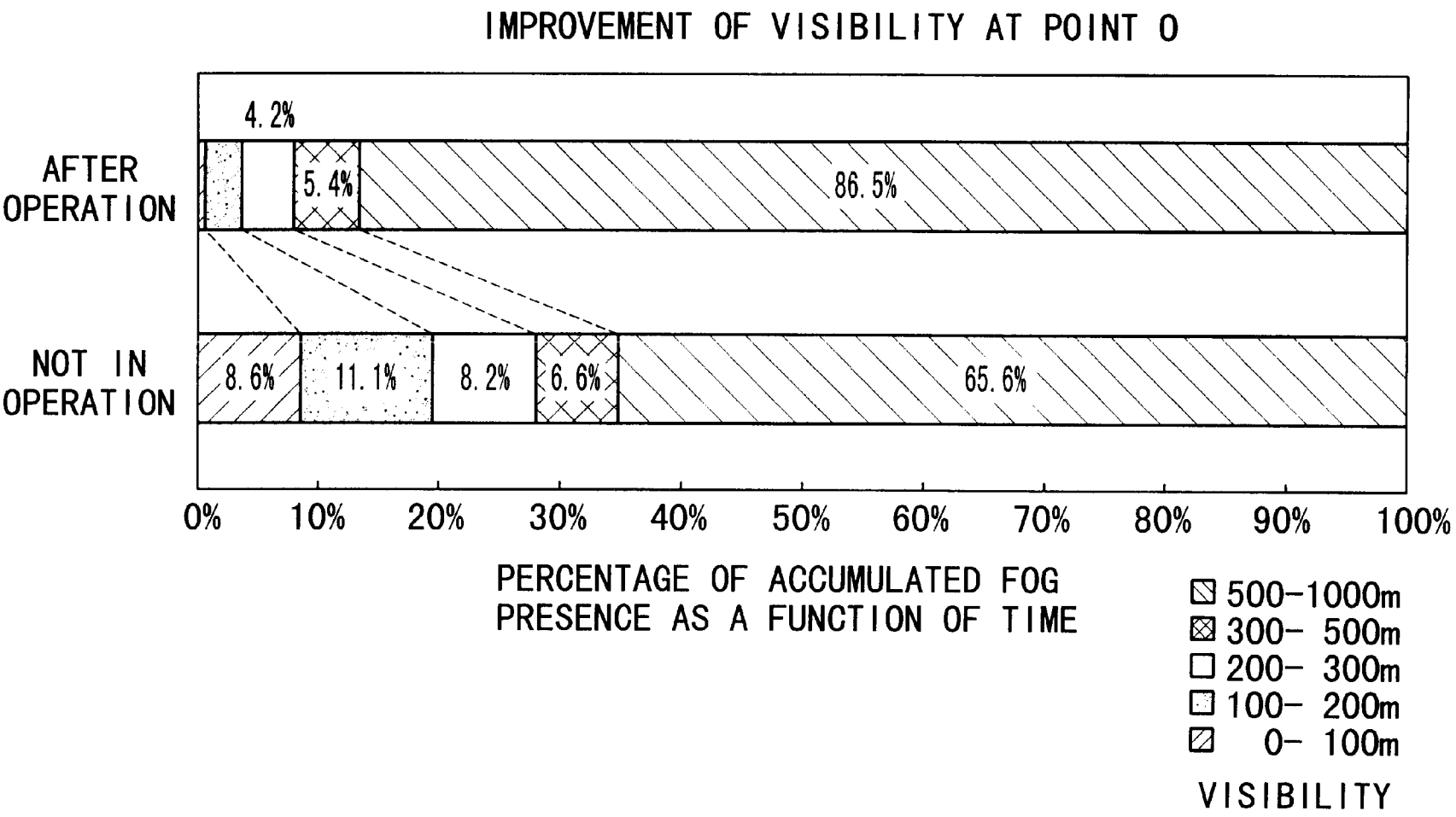
FIG. 10 is a bar graph showing percentage of accumulated fog presence as a function of time at a point O of FIG. 6.

It should be noted that, from the fog dispersal effect at the point O in FIG. 10, the percentage of visibility of above 0 and below 100 m, above 100 m and below 200 m, and above 200 m and below 300 m remarkably decrease, improving the visibility.

Figure 11:
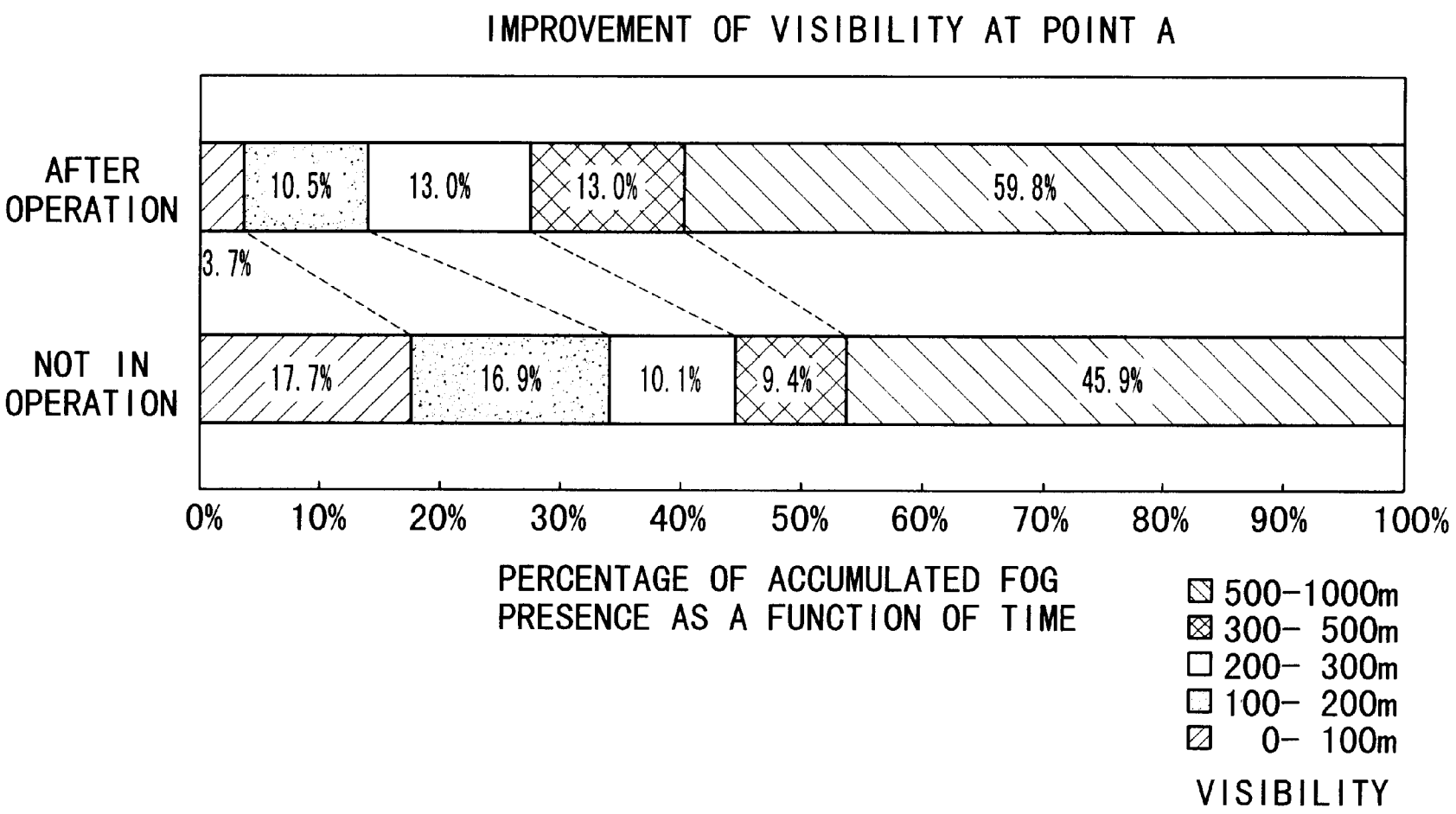
FIG. 11 is a bar graph showing percentage of accumulated fog presence as a function of time at a point A of FIG. 6.

In FIG. 11, the percentage of visibility of above 0 and below 100 m, and above 100 m and below 200 m at the point A decrease, improving the visibility, while the percentage of visibility of above 200 m and below 300 m, and above 300 m and below 500 m increase. It seems that the increase in visibility of above 200 m and below 300 m causes the decrease in visibility of 100 m or 200 m due to the dispersal of the fog.

Figure 12:
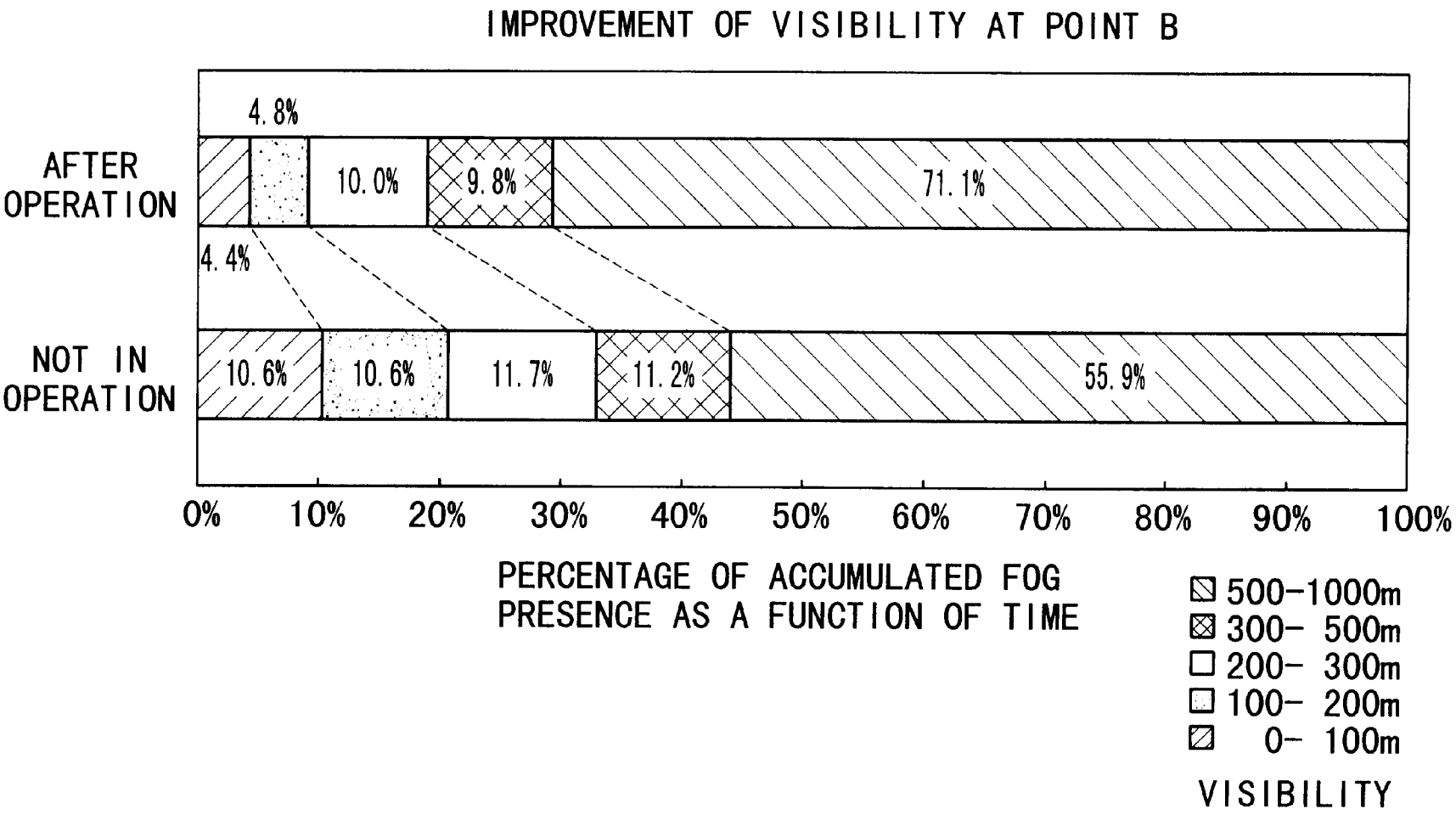
FIG. 12 is a bar graph showing percentage of accumulated fog presence as a function of time at a point B of FIG. 6.

In FIG. 12, the percentage of visibility of above 0 and below 100 m and above 100 m and below 200 m at the point B decrease, improving the visibility.

Figure 13:
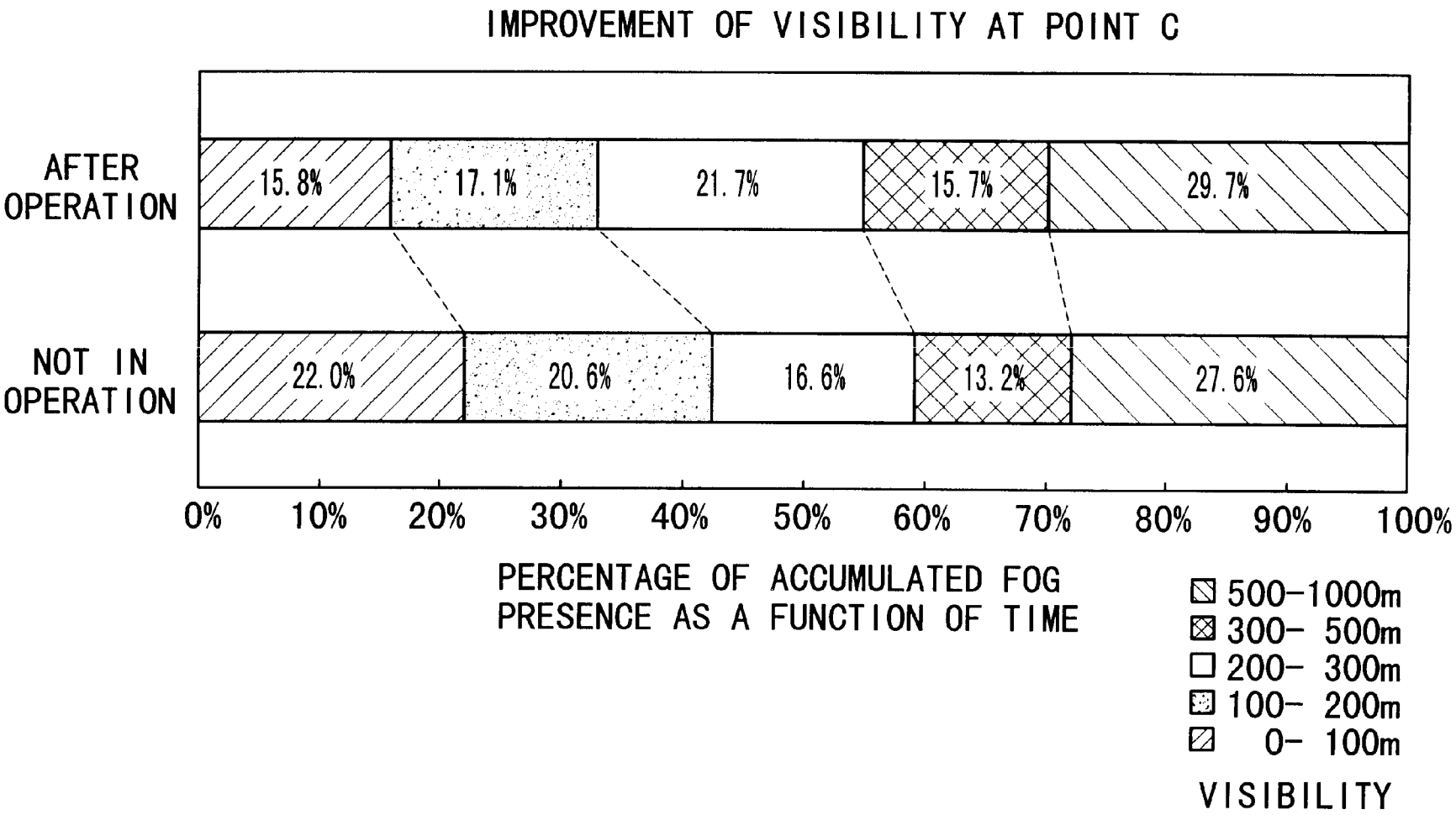
FIG. 13 is a bar graph showing percentage of accumulated fog presence as a function of time at a point C of FIG. 6.

In FIG. 13, the ratio of visibility of above 0 and below 100 m at the point C decreases from 22.0% to 15.8%. At the point distant from the point O by 5 km, the improvement of the visibility is not satisfactory.

From these results, when the large scale installation is built and functioning (operated), the fog dispersal operation covers the areas several kilometers from the installation, improving the visibility.

As shown in FIG. 6, there are mountains and valleys between the points O, A, B, and C along the land traffic road to which the embodiment is applied, and, as shown in FIG. 7, the geographical features are irregular and complicated. Even in such an area, the fog dispersal operation covers distant places.

The method for dispersal of the fog and the installation thereof includes the following techniques:

1) the applicability of the installation for dispersal of fog to railroads in addition to land traffic roads,
2) the applicability to airports,
3) the applicability to golf courses,
4) the applicability to harbors
5) the applicability to sports grounds,
6) loading the installation on ships or vehicles, and dispersing fog while covering a necessary area, and
7) setting the negative direct current voltage to a high voltage of more than −75 kV as shown in the embodiment.

According to the method for dispersal of the fog and the installation thereof of the present invention has the following effects:

1) Because a plurality of the electrodes in the applying means face the ground level and are arranged along one continuous level, and because the electrical potential is set to the same value, the delivery of the electric force lines in the air is improved, thereby expanding the fog dispersal range, and improving the visibility from the installation point to distant places.

2) By setting a plurality of the electrodes to the same height and to the same electrical potential, control of the fog dispersal area and the operation management is simplified.

3) By setting a plurality of the electrodes to the same height and applying the same voltage to the electrodes, the installation is simplified and the costs are reduced.

4) By aligning the applying means along one continuous level, the applicability to land traffic roads such as automobile roads and railroads with large areas, airports, harbors, golf courses, and sports grounds can be enhanced.

5) Because only the negative direct current high voltage of −55 kV is applied to the applying means, the power supply installation can be easily obtained and constructed, and this enhances freedom in the design, such as the size of the installation.

6) Because a plurality of wires to each pole is elevated in parallel, installation of the elevated wires becomes easy.

What is claimed is:

1. A method for dispersal of fog, wherein by aligning a plurality of electrodes (15) of an applying means (14) in a discharge means (1) along one continuous plane (B) and applying the same voltage to a plurality of the electrodes, electric force lines (E) are directed upward above the applying means, and by generating charged particles based on corona discharge from the applying means and allowing the charged particles to absorb water in the air, condensing and binding into water, the fog is dispersed, and wherein the plurality of the electrodes (15) are supported by each single pole, (11), and are aligned in parallel at the same level.

2. A method for dispersal of fog according to claim 1, wherein a plurality of the electrodes (15) of the applying means (14) are set to the same height.

3. A method for dispersal of fog according to any one of claims 1 and 2, wherein a voltage applied to the applying means (14) is a negative direct current high voltage of more than −55 kV.

4. An installation for dispersal of fog, comprising:

a discharge means (1) in which an applying means (14) includes a set of a plurality of electrodes (15); and a power supply means (2) for supplying a direct current high voltage to the discharge means, wherein a plurality of the electrodes face the ground level (G), are aligned along one continuous plane (B), are separated from each other at specified intervals in the horizontal direction, and are set to the same electrical potential, and wherein the plurality of the electrodes (15) are supported by each single pole (11), and are aligned in parallel at the same level.

5. An installation for dispersal of fog according to claim 4, wherein a negative direct current high voltage is applied to a plurality of the electrodes (15) in the applying means (14).

6. An installation for dispersal of fog according to any one of claims 4 and 5, wherein the electrodes (15) are formed by arranging a plurality of corona discharge wires in a horizontal direction in parallel.

* * * * *